US005173714A

United States Patent [19]

Arimura et al.

[11] Patent Number: 5,173,714

[45] Date of Patent: Dec. 22, 1992

[54] SLOT ARRAY ANTENNA

[75] Inventors: Kunitaka Arimura, Chigasaki; Fumio Takenaga, Kawasaki; Hiroshi Kasuga; Akira Tsukada, both of Chigasaki, all of Japan

[73] Assignee: Arimura Giken Kabushiki Kaisha, Chigasaki, Japan

[21] Appl. No.: 518,671

[22] Filed: May 3, 1990

[30] Foreign Application Priority Data

May 16, 1989 [JP] Japan ..... 1-124067

[51] Int. Cl.[5] ..... H01Q 13/10

[52] U.S. Cl. ..... 343/771; 343/770

[58] Field of Search ..... 343/770, 771, 767, 772, 343/786, 753, 774, 776, 779

[56] References Cited

U.S. PATENT DOCUMENTS

| | | | |
|---|---|---|---|
| 2,479,209 | 8/1949 | Chu | 343/771 |
| 2,807,800 | 9/1957 | Broussaud | 343/771 |
| 3,243,818 | 3/1966 | Holtzman | 343/771 |
| 3,311,917 | 3/1967 | Thourel | 343/771 |
| 3,348,227 | 10/1967 | Rolfs | 343/771 |
| 3,524,189 | 8/1970 | Jones, Jr. | 343/771 |
| 3,599,216 | 8/1971 | Paine | 343/771 |
| 4,518,967 | 5/1985 | Westerman | 343/771 |

FOREIGN PATENT DOCUMENTS

| | | |
|---|---|---|
| 0067006 | 3/1989 | Japan . |
| 0067007 | 3/1989 | Japan . |

OTHER PUBLICATIONS

Palumbo, et al., "Circularly Polarized L-Band Planar Array for Aeronautical Satellite Use", Agard Conference Proceedings No. 139, Nov. 1973, pp. 22.1-22.15.

*Primary Examiner*—Rolf Hille
*Assistant Examiner*—Hoanganh Le
*Attorney, Agent, or Firm*—Schwartz & Weinrieb

[57] ABSTRACT

A slot array antenna is composed of a rectangular waveguide formed by means of oppositely disposed plates and side plates, and a power feeder means connected to the rectangular waveguide at a power feed opening. A plurality of wave radiation slots are formed within one of the plates. The power feeder means is arranged such that two powers fed therein are changed into two plane waves, at the power feed opening, having two independent dominant modes. The slots comprise longitudinal slots extending in a longitudinal direction of the waveguide and lateral slots extending in a lateral direction of the waveguide so as to radiate two plates waves respectively.

19 Claims, 16 Drawing Sheets

SLOT ARRAY ANTENNA

FIELD OF THE INVENTION

The present invention relates to a slot array antenna formed by means of a rectangular waveguide for use within the communication, broadcasting and other related or similar fields or areas of technology.

BACKGROUND OF THE INVENTION

A slot array antenna comprises a plurality of slots formed within a plate portion of the rectangular waveguide. FIGS. 21*a* and 21*b* show wave propagation modes within the rectangular waveguide. The wave propagation mode, within the rectangular waveguide is a dominant mode ($TE_{10}$ or $TE_{01}$ wave) the attenuation of which is the smallest, and which may be represented by means of orthogonal coordinates. If the cutoff frequency is designated fc, the speed of light as c, and the length of the long side of the waveguide as a, the waveguide is used within the frequency range between $fc=c/2a$ and $fc(20)=c/a$ at which attenuation of another higher order mode occurs. Accordingly, the long side length a of the waveguide is between $$a=\lambda/(1.06\sim1.3\sim1.56)$$

where $\lambda$ is the free space wavelength.

The slots of a conventional slot array antenna as shown in FIG. 22 are formed within a plate portion of the above described waveguide. As shown in FIG. 22, the direction of the current is inverted at every one-half wavelength interval $\lambda g/2$($\lambda g$ is the wavelength within the waveguide) and the direction of the inclination of each slot is accordingly oppositely disposed with respect to each adjacent slot. Thus, all of the Z-components of the resultant electrical field of the wave radiated from each slot are oriented in one direction, and the Y-components are disposed in opposite phase with respect to each other so as to offset or cancel each other. As a result, a wave having linear polarization is radiated from the slots. The width of the beam in the x-y plane is between 16° and 20° and that in the x-z plane is between 1° and 2° which is in proportion to the number of slots and hence is narrow.

Since the beam width in the horizontal plane x-z is narrow and the beam width in the vertical plane x-z is wide, the gain of the above described slot array antenna is small. Consequently, the antenna is improper to use as an antenna for the communication, broadcasting and similar fields, although it is useful within radar systems.

OBJECTS OF THE INVENTION

An object of the present invention is to provide a slot array antenna which is useful as an antenna for the communication and broadcasting fields, is simple in construction and is light in weight.

Another object of the present invention is to provide a slot array antenna which may simultaneously radiate two kinds of linearly polarized waves which are perpendicular with respect to each other.

SUMMARY OF THE INVENTION

According to the present invention, there is provided a slot array antenna having a rectangular waveguide formed by means of opposed rectangular metallic plates and metallic side plates secured to the sides of each rectangular plate so as to form a rectangular waveguide space having a rectangular sectional shape and to form a power feed opening, a power feeder means being connected to the rectangular waveguide at the power feed opening, the rectangular waveguide having a plurality of wave radiation slots formed in within one of the rectangular metallic plates and arranged in longitudinally extending, laterally spaced rows defining a slot array extending in longitudinal and lateral directions, the height of the side plates being at least one-half of the wavelength within the waveguide space.

The power feeder means is arranged such that two wave powers fed therein are changed to two plane waves at the power feed opening having two independent dominant modes which intersect perpendicularly with respect to each other in parallel with the width direction and the height direction of the power feed opening respectively, and the slots comprise longitudinally extended slots aligned in the longitudinal direction of the waveguide and laterally extending aligned slots in the lateral direction of the waveguide so as to radiate the two independent linearly polarized waves respectively.

In accordance with one aspect of the present invention, the rectangular waveguide has slow-wave means.

The slot array antenna may comprise a plurality of rectangular waveguides connected with each other.

BRIEF DESCRIPTIONS OF THE DRAWINGS

These and other objects and features of the present invention will become more apparent from the following detailed description with reference to the accompanying drawings, in which like reference characters designate like or corresponding parts throughout the several views, and wherein:

FIG. 1 is a perspective view showing a first embodiment of a slot array antenna constructed according to the present invention;

FIGS. 2*a* and 2*b* are sectional views of the waveguide for showing the directions of polarization;

FIGS. 3*a* and 3*b* show arrangements of power radiation slots of the antenna;

FIG. 4 is a graph showing the power density distribution within the space of the waveguide antenna;

FIGS. 5*a* and 5*b* are illustrations showing the radiation directive patterns of the antenna;

Figure 10A:
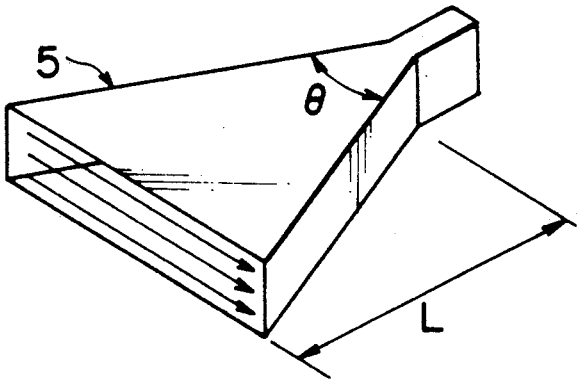
Figure 10B:
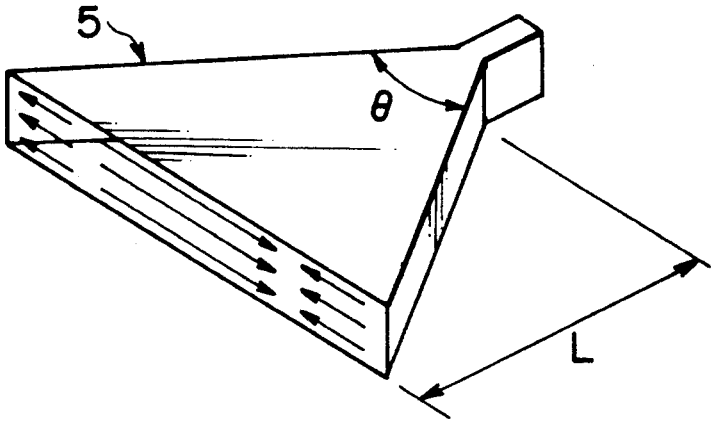
Figure 11:
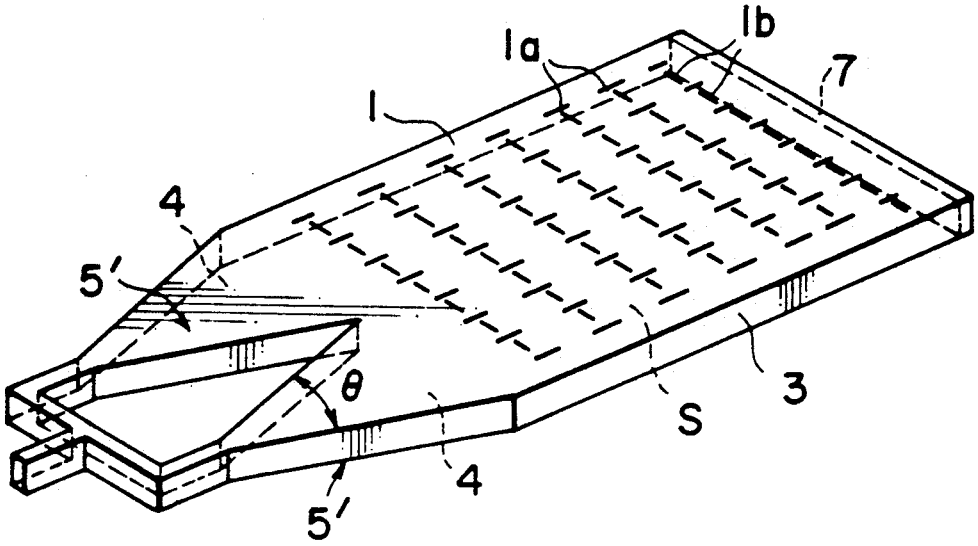
Figure 12:
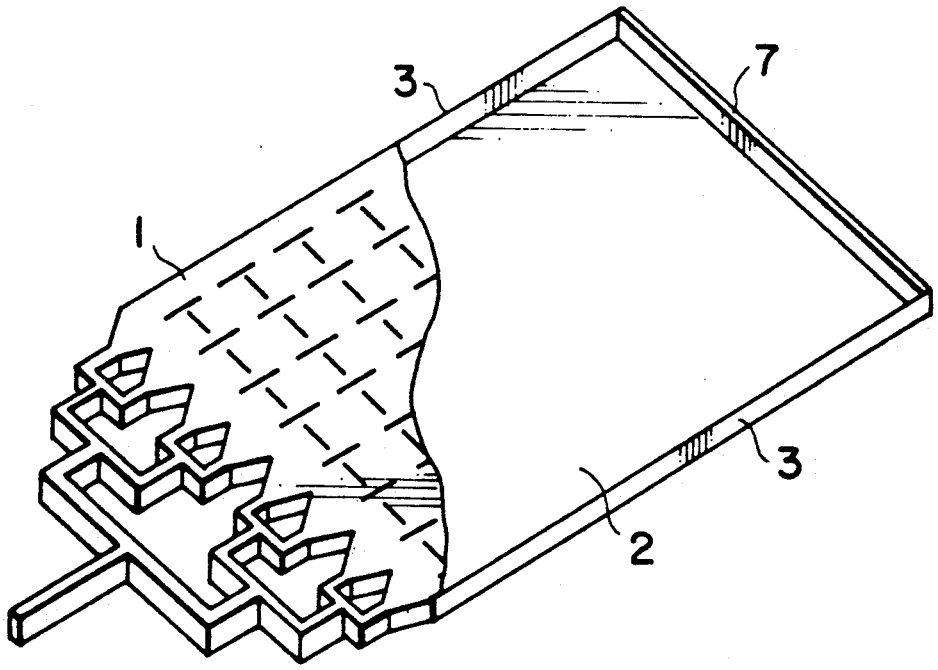
Figure 13:
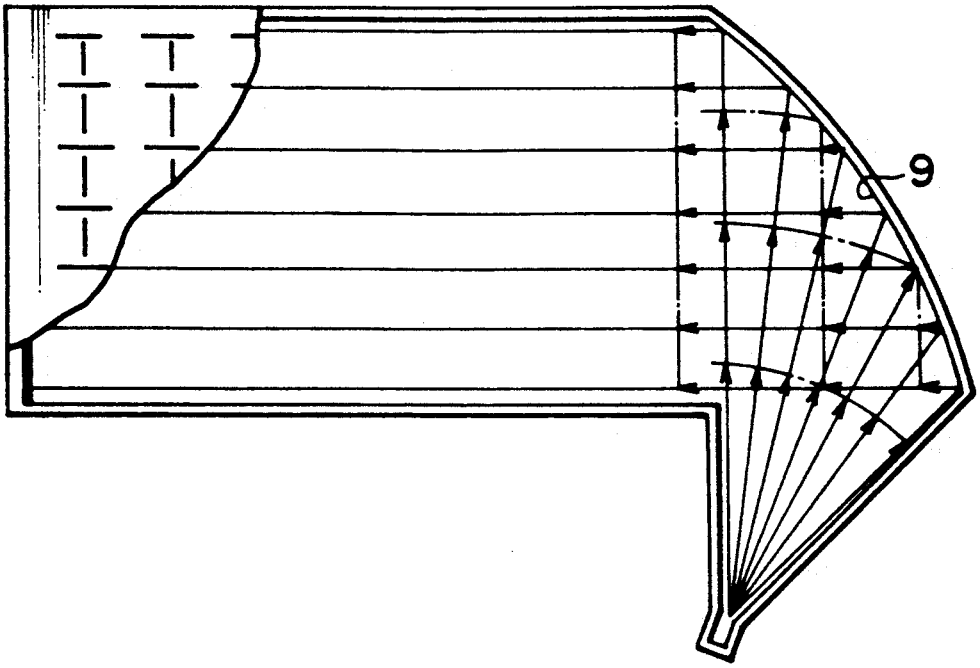
Figure 14:
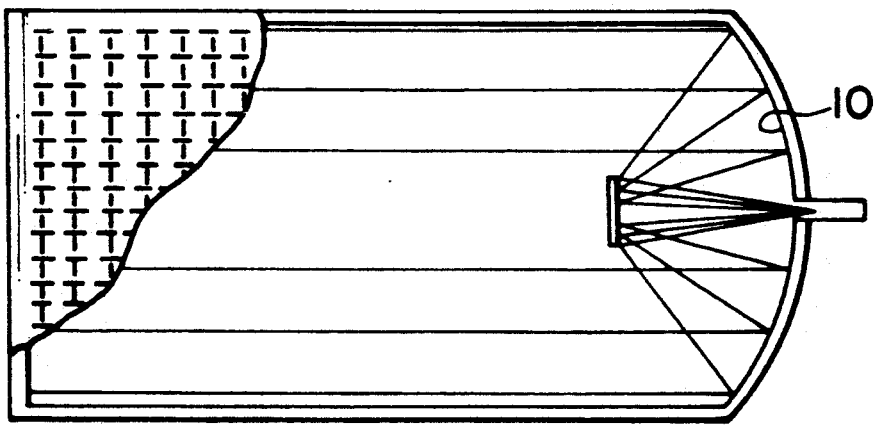
Figure 15:
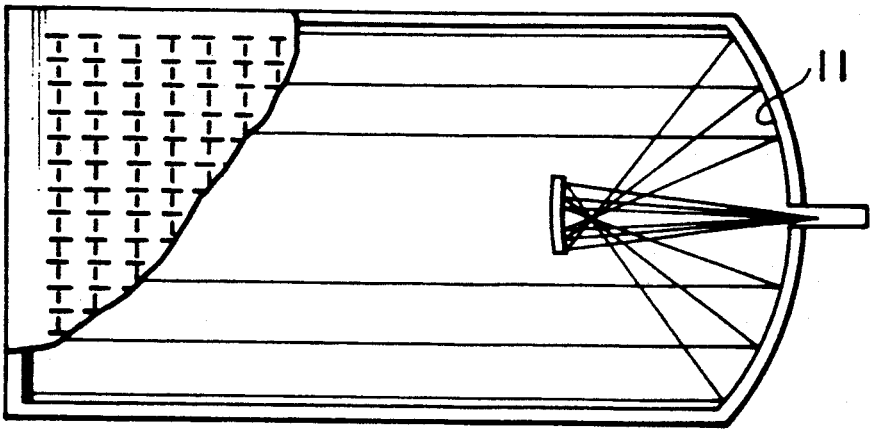
Figure 16:
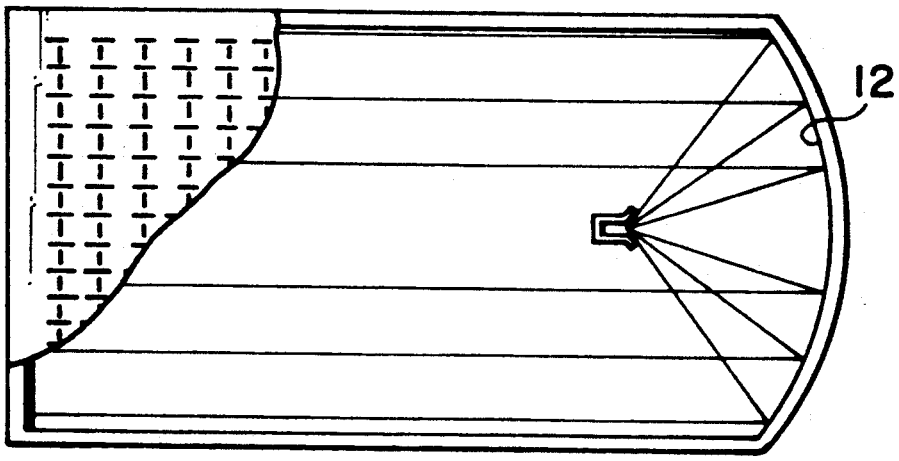
Figure 17:
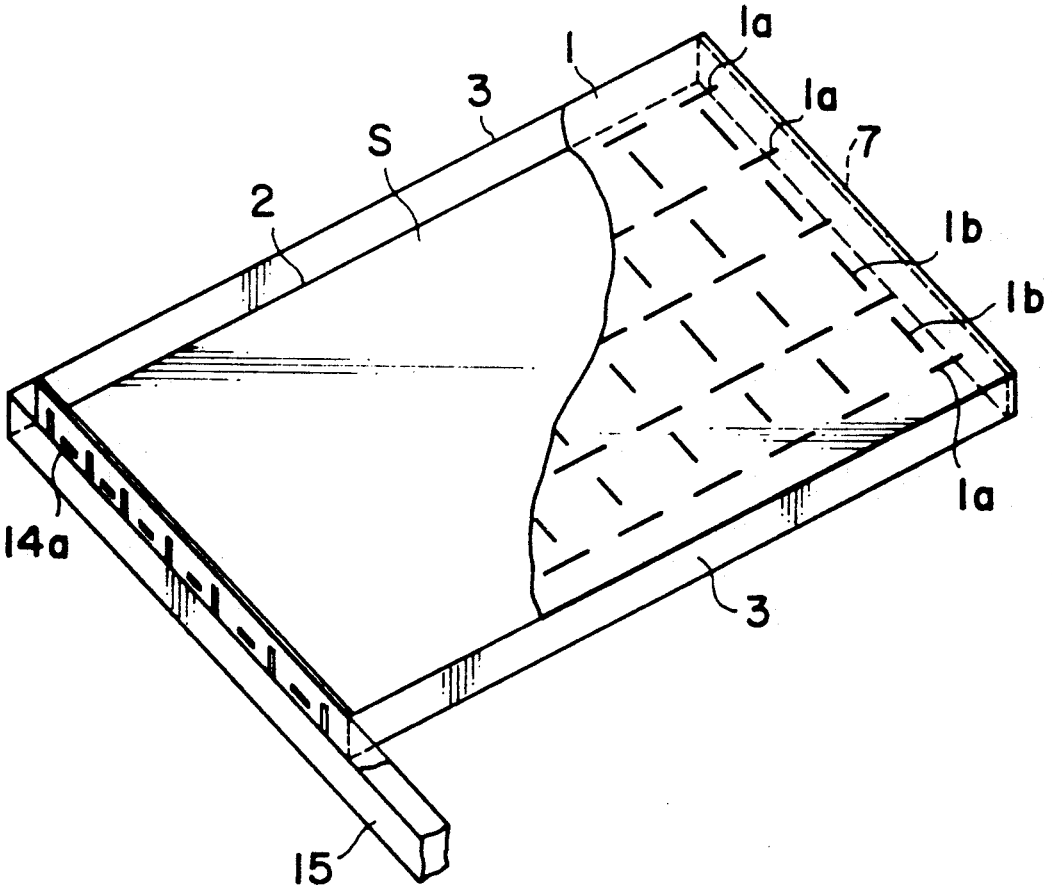
Figure 18:
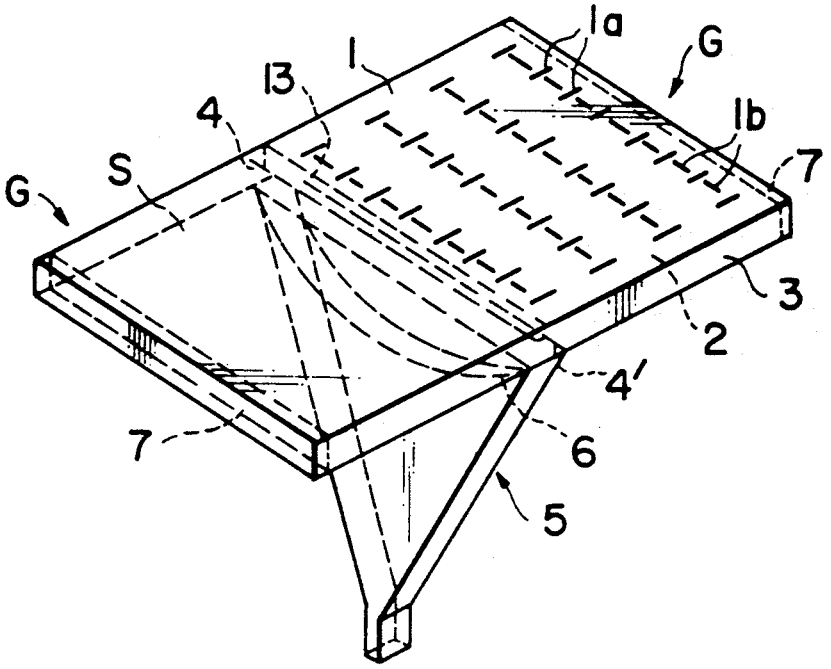
Figure 20:
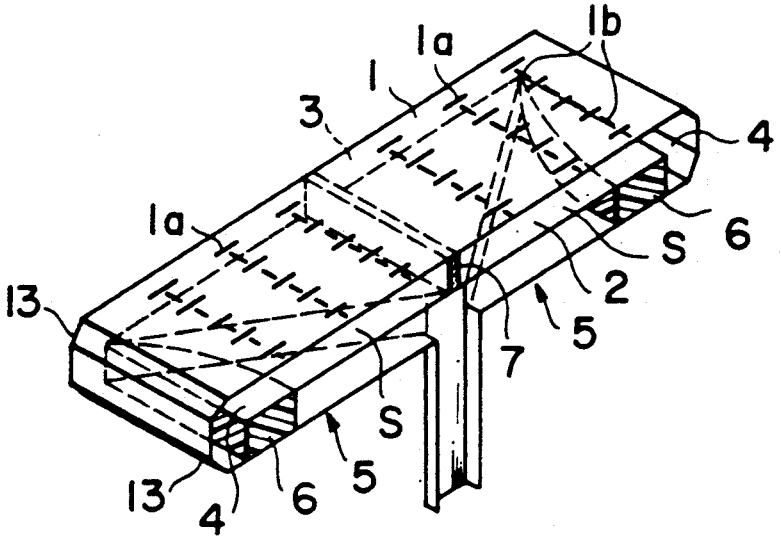
Figure 19A:
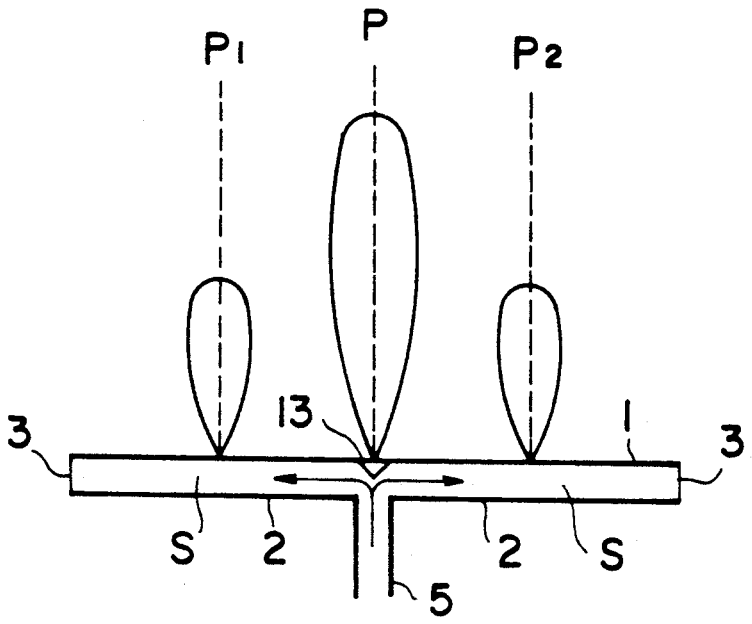
Figure 19B:
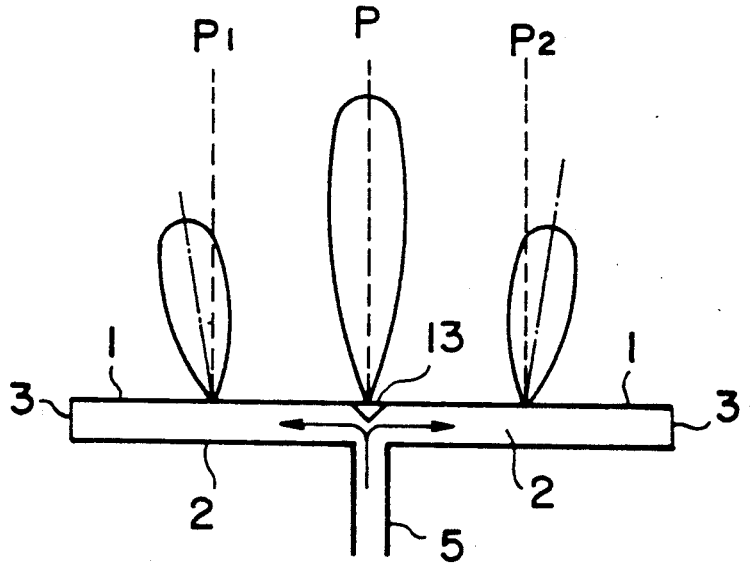
Figure 21A:
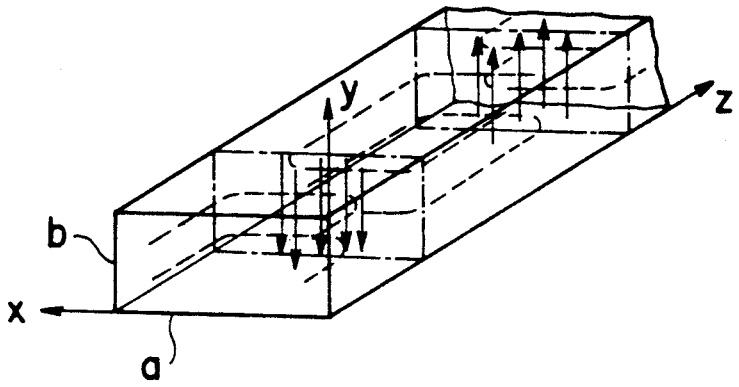
FIG. 21a PRIOR ART
Figure 21B:
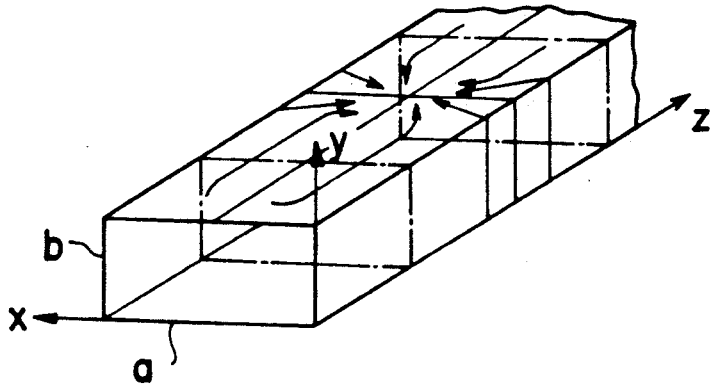
FIG. 21b PRIOR ART
Figure 22:
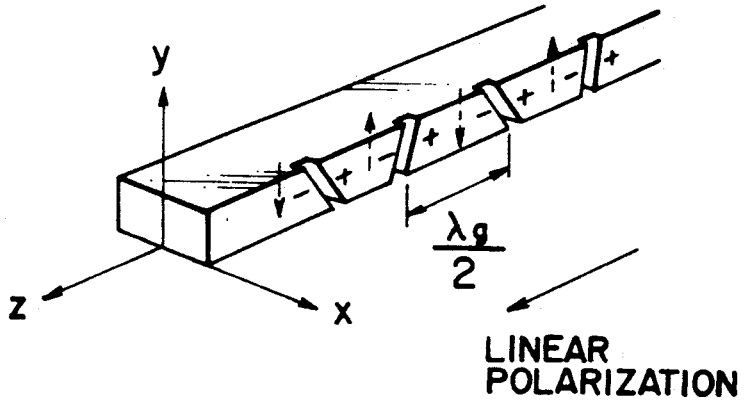
FIG. 22 PRIOR ART

FIGS. 10*a* and 10*b* are perspective views showing horn waveguides of the antenna for explaining the generation of the higher mode waves;

FIGS. 11 and 12 are perspective views showing first and second modifications of the first embodiment of the present invention so as to comprise fifth and sixth embodiments of the present invention;

FIG. 13 is a plan view showing a third modification of the slot array antenna comprising a seventh embodiment of the present invention;

FIG. 14 is a plan view showing a fourth modification of the slot array antenna comprising an eighth embodiment of the present invention;

FIG. 15 is a plan view showing a fifth modification of the slot array antenna comprising a ninth embodiment of the present invention;

FIG. 16 is a plan view showing a sixth modification of the slot array antenna comprising a tenth embodiment of the present invention;

FIG. 17 is a perspective view showing a seventh modification of the slot array antenna comprising an eleventh embodiment of the present invention;

FIG. 18 is a perspective view showing a twelfth embodiment of the present invention;

FIGS. 19*a* and 19*b* are illustrations showing the directivity of the antenna of the twelfth embodiment of the present invention;

FIG. 20 is a perspective view showing a thirteenth embodiment of the present invention;

FIGS. 21*a* and 21*b* are illustrations showing wave propagations within a conventional antenna; and FIG. 22 is a perspective view showing a conventional slot array antenna.

DETAILED DESCRIPTION OF THE ILLUSTRATED EMBODIMENTS

Figure 1:
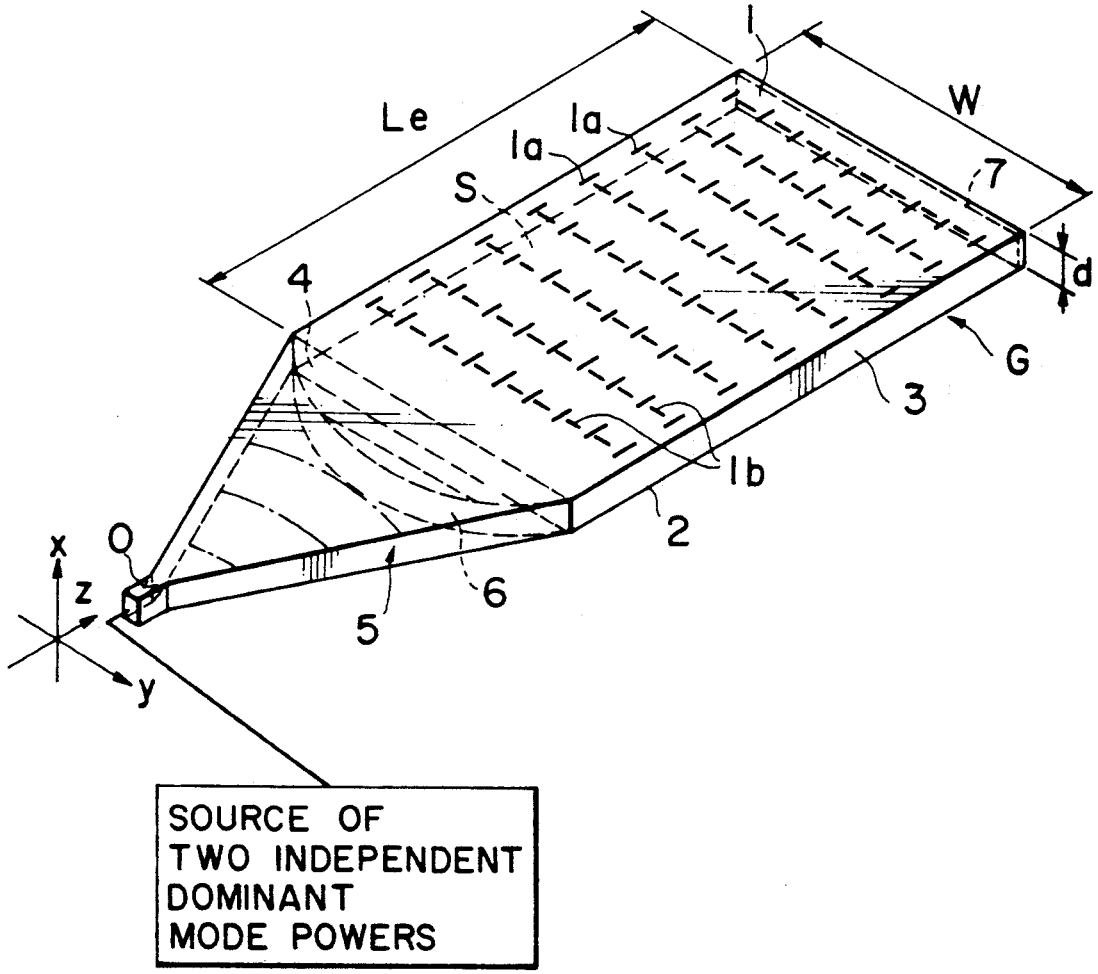

Referring to FIG. 1 showing a first embodiment of the present invention, a slot array antenna constructed according to the present invention comprises a rectangular waveguide G having a power feed opening 4 formed at an inlet side thereof, and a horn waveguide 5 connected to the rectangular waveguide G at the power feed opening 4. The rectangular waveguide G comprises opposed rectangular metallic plates 1 and 2, and metal side plates 3 secured to the three sides of each plate 1 and 2, which are not associated with power feed opening 4, so as to form a rectangular waveguide space S having a rectangular sectional shape. The width W of the rectangular waveguide is at least three times as large as the wavelength λg (3 λg) within the space S and the length Le is at least 10 λg. The height d is at least one-half of the wavelength λg (λg/2). The metallic plate 1 has a plurality of power radiation slots 1*a* and 1*b*, arranged extending longitudinally and laterally so as to be aligned in the longitudinal and lateral directions. Each slot 1*a* is directed in the longitudinal direction and each slot 1*b* is directed in the lateral direction. Upon the inside of the end side plate 3 of the rectangular waveguide G, a terminal resistor 7 is provided. The horn waveguide 5 has a horn shape and has a lens antenna 6 disposed therein. The lens antenna 6 may be made of dielectric or a metallic plates, or corrugated metallic plate.

Within the horn waveguide 5, two kinds of powers are fed, one of which is the power of the dominant mode $TE_{01}$ of the 14 GHz band and the direction of the electrical field is lateral (that is in the width W direction), and the other is the power of the dominant mode $TE_{10}$ of the 12 GHz band and the direction of the electrical field is vertical (that is the height d direction).

Figure 2A:
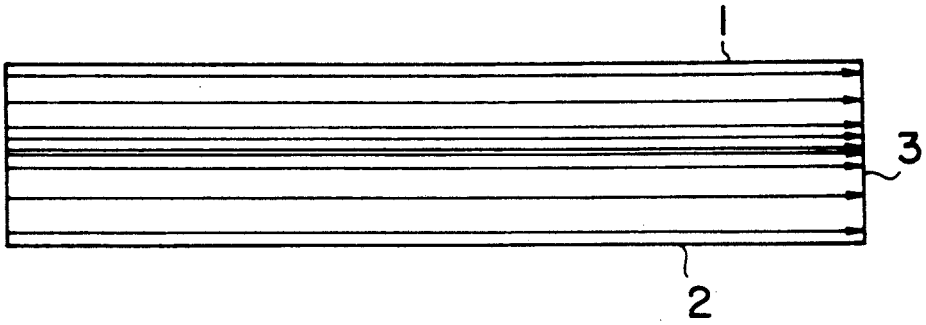
Figure 2B:
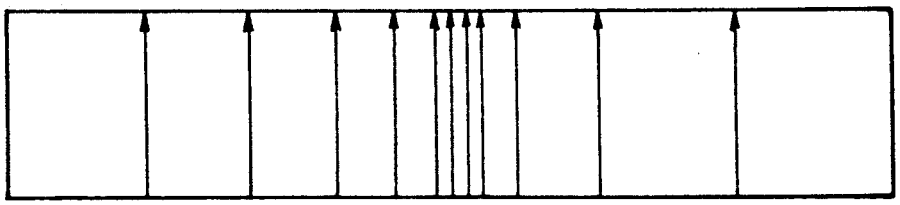

Each power propagates within the horn waveguide 5, with respect to the phase fronts being coaxial with an ideal origin O. The powers are converted to the dominant modes $TE_{10}$ and $TE_{01}$ respectively when passing through the lens antenna 6, such that each becomes a substantially plane wave. Thus, the power is fed to the rectangular waveguide G in the form of a plane wave. The electrical field of the power of the 14 GHz band is shown in FIG. 2*a*, and the electrical field of the power of the 12 GHz band is shown in FIG. 2*b*. Thus, each power propagates within the waveguide G in accordance with its independent dominant mode.

The power of the 14 GHz band with the (electrical field in the W direction) excites the longitudinal slots 1*a* and equiphase power radiates from the slots 1*a*. On the other hand, the power of the 12 GHz band with the (electrical field in the d direction) excites the lateral slots 1*b* and equiphase power radiates from the slots 1*b*. Residual power remaining with the rectangular waveguide G is absorbed within the terminal resistor 7, thereby preventing any adverse influence as a result of reflected power. If the waveguide G is so designed that the power fed from the horn waveguide 5 is exhausted as a result of the radiation from the slots 1*a* and 1*b*, the terminal resistor 7 is unnecessary.

Figure 3A:
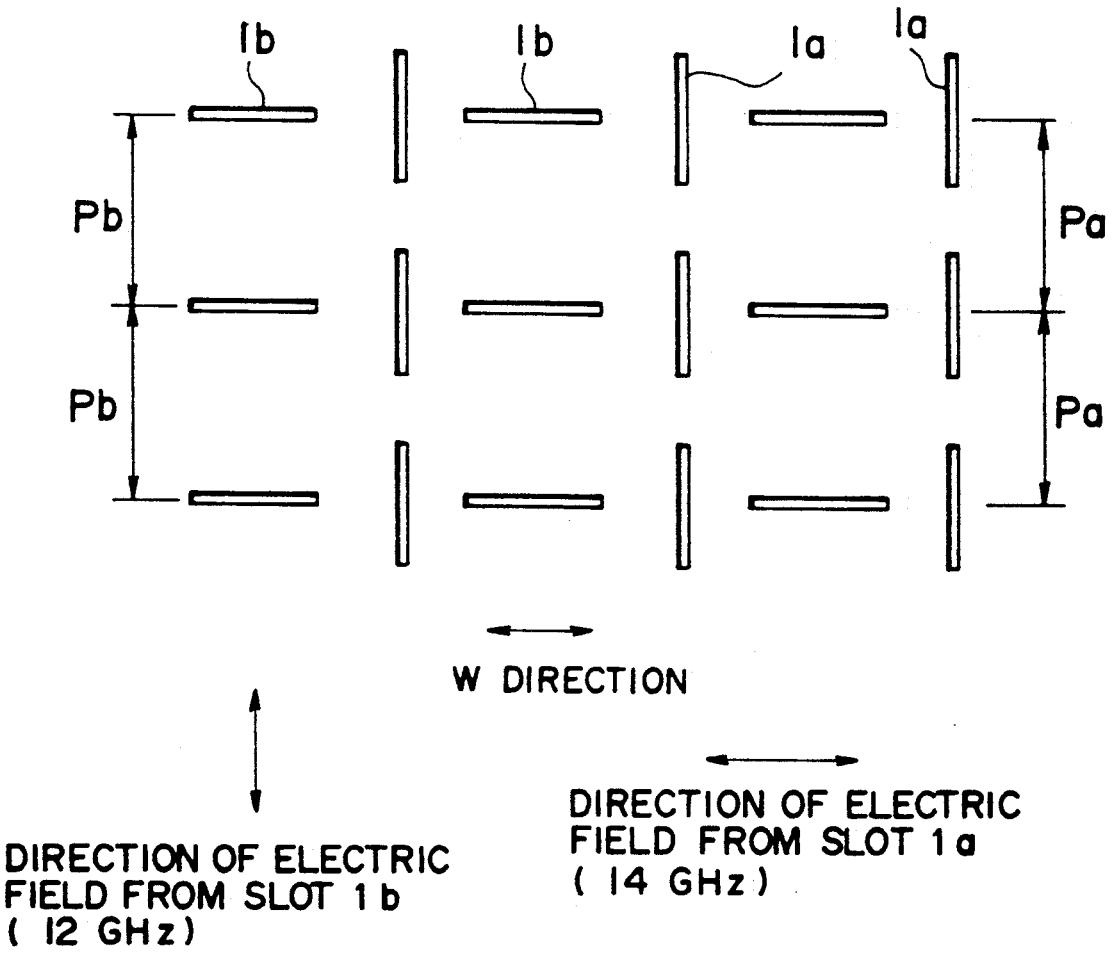
Figure 3B:
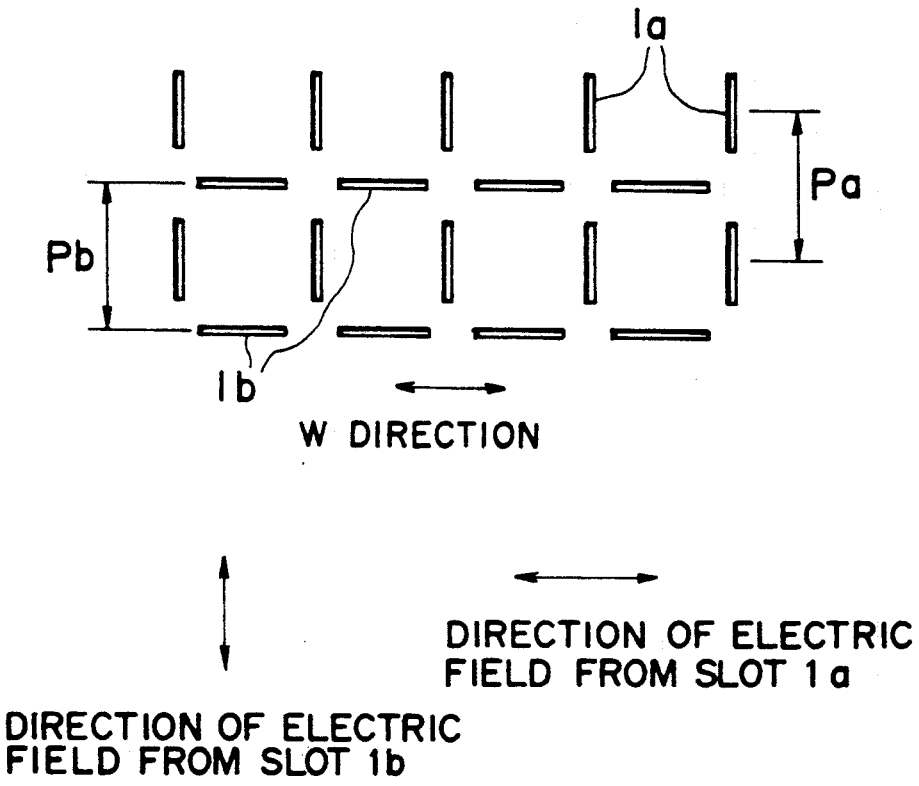

FIGS. 3*a* and 3*b* show arrangements of the slots 1*a* and 1*b*. The slots 1*a* are separated or spaced by means of a distance Pa, as measured from the longitudinal center of one slot to the longitudinal center of the next slot, which is equal to the wavelength λg′ (that is, the wavelength within the waveguide at 14 GHz) and slots 1*b* are separated or spaced by means of a distance λg (that is, the wavelength within the waveguide at 12 GHz). Thus, linearly polarized waves which are independent and perpendicularly intersect each other are radiated from slots 1*a* and 1*b* as shown in FIGS. 3*a* and 3*b*. Since scores of slots 1*a* and 1*b* are arranged in the longitudinal and lateral directions, the directivity of the antenna and the gain of the antenna are significantly improved. The antenna is useful as a communication antenna wherein the 12 GHz frequency band is used for receiving the waves and the 14 GHz frequency band is used for transmitting the waves. Furthermore, the antenna may also be useful as a satellite broadcast receiver and a satellite communication wherein both are operative at the 12 GHz frequency band level.

Figure 4:
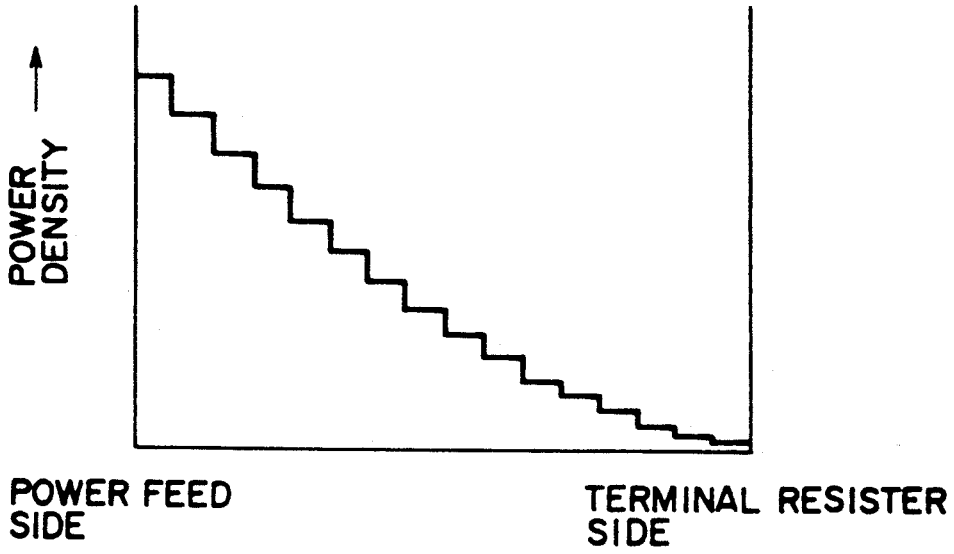

FIG. 4 shows a power density distribution within the waveguide space S of the waveguide G according to the first embodiment. The power density is reduced as one proceeds toward the terminal resistor 7 because of the radiation of the power from slots 1*a* and 1*b*. Consequently, the power distribution is irregular so that the antenna gain is reduced.

Figure 7:
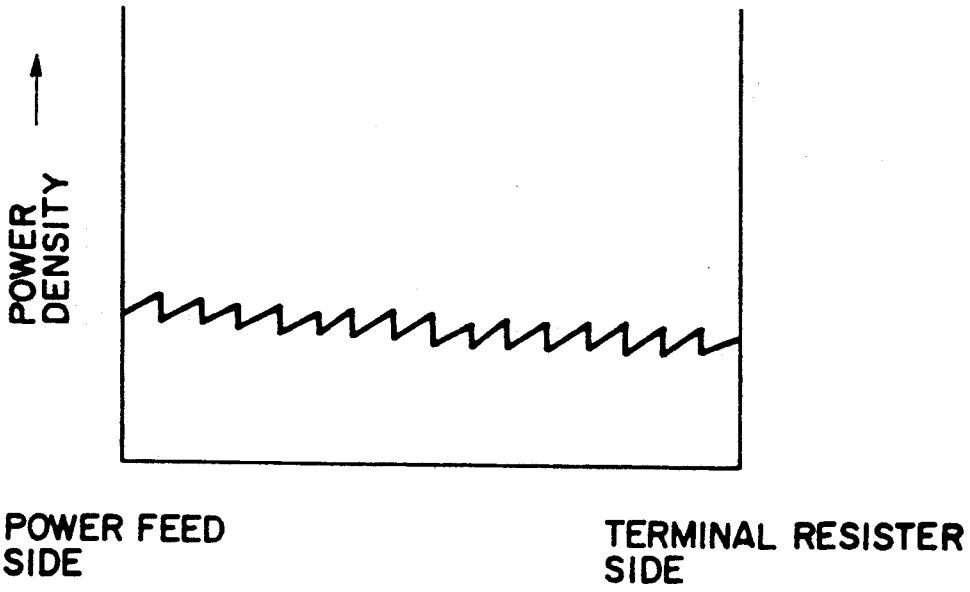
FIG. 7 is a graph showing the power density distribution of the second embodiment antenna of the present invention.
Figure 6:
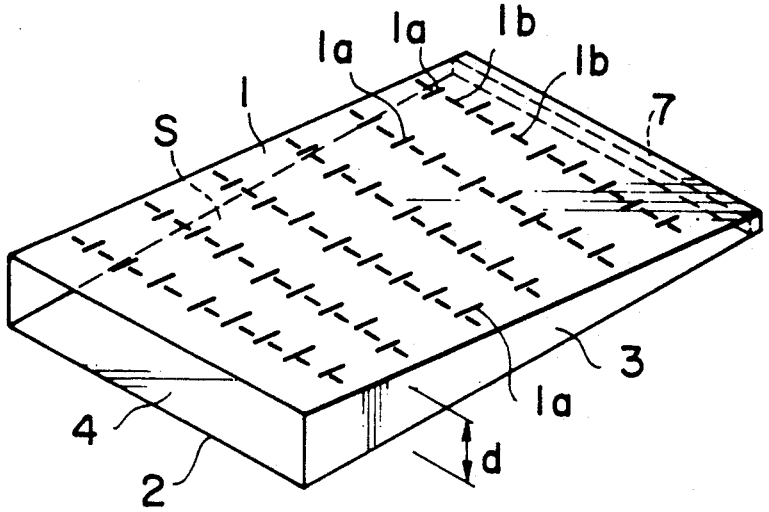
FIG. 6 is a perspective view showing a second embodiment of a slot array antenna constructed in accordance with the present invention.

The second embodiment shown in FIG. 6 is provided so as to uniformly radiate the power. The height d of the waveguide, and therefore of the waveguide space S of the rectangular waveguide is reduced as one proceeds from the power feed opening 4 toward the terminal resistor 7 along a straight line or along a curve. Thus, the power is substantially uniformly distributed as shown in FIG. 7, thereby increasing the antenna gain.

However, in such an antenna, the height d must be $d > \lambda g'/2$ so as not to terminate the power within the waveguide space S. In addition, the wavelength λg′ within the waveguide space S also changes as a function of the height d in accordance with the relationship $\lambda g' = \lambda'/\sqrt{(1-(\lambda'/2d)^2)}$, wherein is the wavelength within free space at 14 GHz. Accordingly, it is necessary to design the distance Pa between slots 1*a* in accordance with the change of the wavelength λg′. Other modes of operation and advantages other than those covered or noted within the above description are the same as those of the first embodiment.

Figure 8:
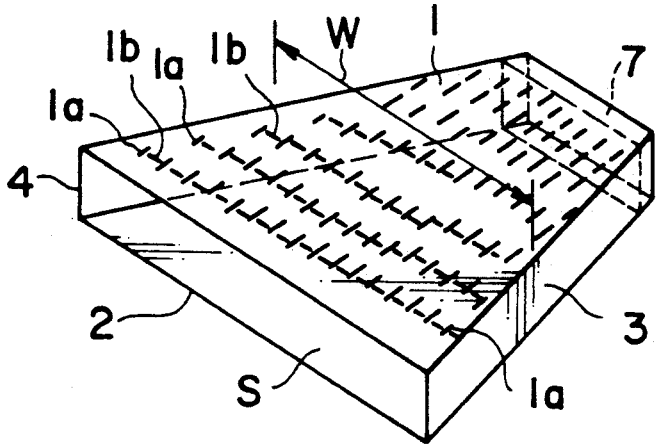
FIG. 8 is a perspective view showing a third embodiment of a slot array antenna constructed in accordance with the present invention.

FIG. 8 shows the third embodiment of the present invention. The width W of the waveguide is reduced as one proceeds from the power feed opening 4 toward the terminal resistor 7 along a straight line or along a curve, thereby providing a substantially uniform distribution of the radiated power. However, since the wavelength λg at 12 GHz changes with the width W, it is unnecessary to change the slot distance Pb as in the second embodiment.

Since the height d is not permitted to be substantially increased, the wavelength λg' within the waveguide space S becomes large when compared with the wavelength λ' within free space, so that the slot distance Pa becomes large. Since the width W is more than 5 λg, the wavelength λg becomes equal to the wavelength λ, which causes grating lobes.

Figure 9:
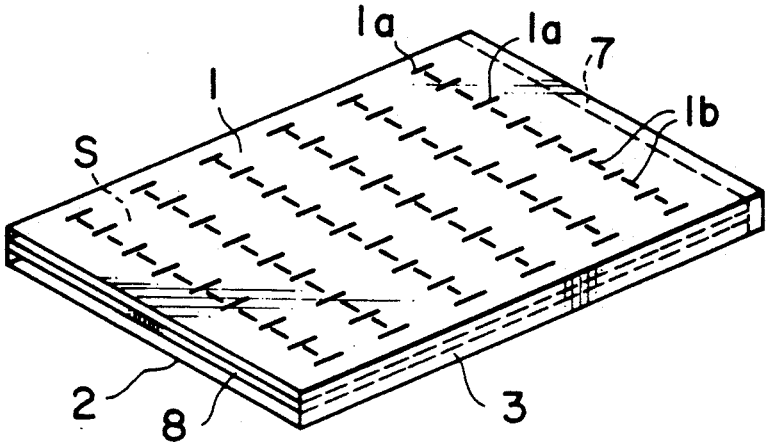
FIG. 9 is a perspective view showing a fourth embodiment of a slot array antenna constructed in accordance with the present invention.

FIG. 9 shows the fourth embodiment of the present invention. Within the waveguide space S, a slow-wave means 8 such as, for example, a dielectric plate is provided. The phase constant of the power propagated within the waveguide space S of the rectangular waveguide G can be controlled by changing the thickness or position of the slow-wave means 8 so as to reduce the wavelength λg and λg' within the waveguide space. The dielectric plate having a thickness of $t<d/2$ is provided within the waveguide space S at an intermediate elevational position thereof. Thus, it is possible to increase the density of the slots so as to increase the efficiency of the antenna. Other operations and advantages other than those noted within the above description are the same as those of the first embodiment.

FIG. 10*a* shows the horn waveguide 5 as a power feed means for the above described antennas. The opening angle θ of the horn waveguide is less than 30° so as to provide the dominant mode wave. If the length L is shortened, the opening angle θ increases. When the opening angle exceeds 30°, a higher mode wave is generated as shown in FIG. 10*b*, causing disruption of the phase.

First and second modifications of the antenna of FIG. 1, and comprising fifth and sixth embodiments of the present invention, are shown in FIGS. 11 and 12, respectively, and they are provided with a horn waveguide which prevents disruption of the phase. The horn waveguide of FIG. 11 has a pair of parallel waveguides 5'. The other parts of the antenna are the same as those of the first embodiment in construction. By means of such construction, the opening angle θ of each waveguide 5' is reduced, so that the power fed within each horn waveguide 5' becomes a virtual plane wave. Thus, the lens antenna 6 can be omitted, and generation of the higher mode wave can be prevented. If the lens antenna 6 is used within each horn waveguide 5' so as to flatten the phase front, the length of each horn waveguide 5' is can be further reduced. The waveguides of the second to fourth embodiments of the present invention, as shown in FIGS. 6, 8, and 9, respectively may be used in connection with the horn waveguide of the first embodiment, or with the horn waveguides of FIGS. 11 and 12 so that operations and advantages due to the respective modifications can be obtained. The embodiment of FIG. 12 is similar to that of FIG. 11 except that more than two, that is, eight, parallel waveguides are utilized with a corresponding decrease in the opening angle of each waveguide.

Referring now to FIGS. 13 to 16 showing the third to sixth modifications of the antenna of the present invention, and therefore comprising the seventh to tenth embodiments of the present invention, the antenna of the third modification has an offset reflector 9, the antennas of the fourth and fifth modifications have a Cassegrain reflector 10 and a Gregorian reflector 11 respectively, and the antenna of sixth modification has a parabolic reflector 12. The power feeder waveguide means is provided upon each reflector. These modifications have substantially the same operations and advantages as those of the first embodiment. The second to fourth embodiments can also be provided with the structural components and features of the antennas of the third to sixth modifications, so that the operations and advantages due to the respective modifications can be obtained.

Referring now to FIG. 17 showing the seventh modification of the antenna and therefore the eleventh embodiment of the invention, a waveguide 15 having feeding openings 14*a* defined within a metallic plate thereof is attached to the rectangular waveguide G as the power feeder means. Each opening 14*a* is a slot having a length of one-half of the wavelength. Other structural features are the same as those of the first embodiment. The power is propagated from the openings 14*a* into the waveguide space S as a plane wave.

The shape of each opening 14*a* may be round or rectangular. By changing the diameter of each round opening, or changing the lengths of the long sides and the short sides of each rectangular opening, or by changing the inclination and position of each rectangular opening, the distribution of the electromagnetic field within the waveguide space S of the rectangular waveguide can be adjusted. Furthermore, the distribution of the radiated power can be equalized. Other operations and advantages other than those discussed within the above description are the same as those of the first embodiment. The antennas of the second to fourth embodiments of the present invention can also be connected to the power feeder means with the waveguide having openings as disclosed in FIG. 17, so that the operations and advantages due to the respective embodiments can be obtained.

Referring now to FIG. 18 showing the twelfth embodiment of the present invention, the antenna comprises a pair of adjacent rectangular waveguides G. Each rectangular waveguide G comprises oppositely disposed rectangular metallic plates 1 and 2, and metal side plates 3 secured to the three sides of each plate 1 and 2 so as to form a rectangular waveguide space S. The width W of the metallic plate 1 is more than 3 λg and the height d of the side plates 3 is more than λg/2. The metallic plate 1 has a plurality of power radiation slots 1*a* and 1*b* arranged in the longitudinal and lateral directions in an array similar to that of the embodiment of FIG. 1. Power feed openings 4 and 4' are formed at the inlet sides of the spaces of both waveguides G, respectively. Both the waveguides are connected with each other, thereby forming a space therebetween. The horn waveguide 5 is disposed perpendicular to, and connected with the underside of the antenna so as to communicate with the space defined between the power feed openings 4 and 4'. A matching member 13 as a reflector member is provided in the space between the openings 4 and 4'. The horn waveguide 5 has a lens antenna 6 disposed therein. The lens antenna 6 may be made of a dielectric material or may comprise a plurality of metallic plates, or may be a corrugated metallic plate. The terminal resistor 7 may be provided if necessary.

Figure 5A:
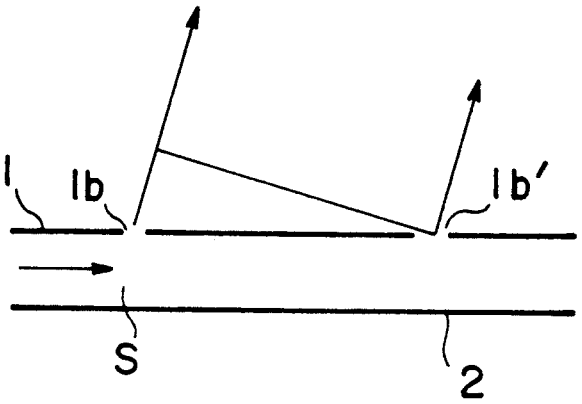
Figure 5B:
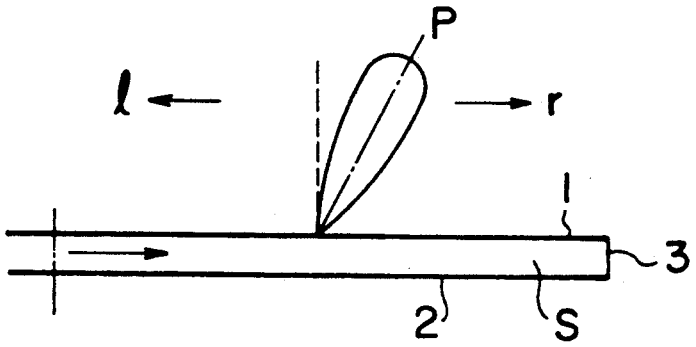

Referring to FIG. 5*a* showing the radiation direction pattern of the first embodiment, if the wavelength λg (λg') within the waveguide space S of the rectangular waveguide is shorter than the set distance Pb (Pa) defined between the slots 1*a* and 1*b*, respectively the phase of the power radiated from the slot 1*b* is in advance of the phase of the power radiated from the slot 1*b'* by means of the amount Pb−λg (Pa−λg), and similarly with respect to the slots 1*a*. Consequently, the main lobe P inclines toward r as shown in FIG. 5*b*. When the wavelength λg is longer than the distance Pb or Pa as the case may be, the main lobe P inclines toward l.

FIGS. 19*a* and 19*b* show the directivity of the antenna of the twelfth embodiment of the present invention as shown in FIG. 18. The power fed from the power feeder means 5 is divided by the means of a matching member 13 and turned 90° into the right and left waveguide spaces S of the rectangular waveguide G. The divided powers propagate symmetrically in the right and left waveguide spaces S. Therefore, if the wavelength of the power changes, the left main lobe P1 and the right main lobe P2 incline symmetrically as shown in FIG. 19*b*. Consequently, the direction of the resultant main lobe P advantageously becomes perpendicular to the surface of the antenna. Other structures or components are the same as those of the first embodiment of the present invention. The power feeder means of this embodiment may be selectively used for the antenna of the second to fourth embodiments. Furthermore, the power feeder means of this embodiment may be substituted for those of the first to seventh modifications shown in FIGS. 11–17.

Referring now to FIG. 20 showing the thirteenth embodiment of the present invention, the rectangular waveguide G comprises a pair of adjacent rectangular waveguides and a pair of horn waveguides 5 provided upon the underside of the rectangular waveguide G. The width W of the metallic plate 1 is more than 3 λg and the height d of the side plates 3 is more than λg/2. The metallic plate 1 has a plurality of power radiation slots 1*a* and 1*b* arranged in the longitudinal and lateral directions in array similar to that of the embodiment of FIG. 1. The rectangular waveguide G has power feed openings 4 at both ends thereof and the terminal resistor 7 is disposed at a central portion thereof. The horn waveguides 5 are disposed parallel and symmetrical with respect to the rectangular waveguide so as to communicate with the power feed openings 4. Within both ends of the rectangular waveguide G, matching members 13 in the form of reflector means are provided for reflecting the fed power into the waveguide spaces S. The lens antenna 6 of dielectric material is provided within each horn waveguide 5. Thus, substantially the same operation and advantages derived from as the first and fifth embodiments can be obtained. The rectangular waveguides of the second to fourth embodiments may be substituted for the waveguide of this embodiment. Furthermore, the feeder means of this embodiment may be substituted for those of the first to seventh modifications.

From the foregoing, it will be understood that the antenna of the present invention has the following advantages:

(1) Two kinds of power of two frequency bands are fed to the waveguide space within the rectangular waveguide in two independent modes and can be radiated from the power radiation slots as linearly polarized waves which perpendicularly intersect each other.

(2) The phase constant of the power propagated within the waveguide space of the rectangular waveguide can be controlled by means of the slow-wave device so as to reduce the wavelength within the waveguide space. Thus, it is possible to increase the density of the slots so as to increase the efficiency of the antenna.

(3) Since a plurality of slot array antennas are connected, the movement of the main lobe direction caused by means of a change of the frequency of the fed power can be prevented.

While the invention has been described in conjunction with preferred specific embodiments thereof, it will be understood that this description is intended to illustrate and not limit the scope of the invention, which is defined by the following claims. Obviously, many modifications and variations of the present invention are possible in light of the above teachings, and therefore, it is understood further that within the scope of the appended claims, the present invention may be practiced otherwise than as specifically described herein.

What is claimed is:

1. A slot array antenna, comprising:

a rectangular waveguide formed by means of a pair of oppositely disposed rectangular metallic plates and metallic side plates secured to side edge portions of each one of said rectangular plates along three sides thereof so as to form a rectangular waveguide space having a rectangular cross-sectional shape and a power feed opening defined within a fourth side thereof, said rectangular waveguide having a plurality of wave radiation slots formed within one of said rectangular metallic plates so as to be disposed within an array which extends in longitudinal and lateral directions, the height of said side plates being at least one-half of the wavelength within said waveguide space; and power feeder means connected to said rectangular waveguide at said power feed opening thereof and comprising a source means for simultaneously feeding two kinds of powers having two independent dominant modes, the electrical fields of which intersect each other perpendicularly in the width direction and the height direction of said power feed opening, respectively, such that the electrical field of one of said two independent dominant mode powers is disposed parallel to said pair of oppositely disposed rectangular metallic plates of said rectangular waveguide while the electrical field of the other one of said two independent dominant mode powers is disposed perpendicular to said pair of oppositely disposed rectangular metallic plates of said rectangular waveguide, toward said rectangular waveguide such that each one of said powers propagates with the phase fronts thereof being coaxial, and means for converting said two independent dominant mode powers having said coaxial phase fronts into two flat equiphase plane waves at said power feed opening of said rectangular waveguide such that the power fed by said power feeder means is propagated within said waveguide space in said two independent dominant modes with said electrical field of each one of said modes being disposed within a flat plane;

said slots comprising longitudinal slots extending in the longitudinal direction of said waveguide, and lateral slots extending in the lateral direction of said waveguide, so as to simultaneously radiate said two flat equiphase plane waves as two independent linearly polarized waves from said longitudinal and lateral slots.

2. The slot array antenna according to claim 1 wherein the rectangular waveguide has slow-wave means disposed therein.

3. The slot array antenna according to claim 1 wherein said rectangular waveguide comprises a plurality of rectangular waveguides connected with each other.

4. An antenna as set forth in claim 3, wherein:

said plurality of rectangular waveguides are disposed in a coplanar array with respect to each other.

5. An antenna as set forth in claim 4, wherein:

said power feeder means comprises a horn waveguide disposed perpendicular to said coplanar array of said plurality of rectangular waveguides.

6. An antenna as set forth in claim 5, wherein:

each of said rectangular waveguides comprises a power feed opening; and a matching member is interposed between said power feed openings of said rectangular waveguides.

7. An antenna as set forth in claim 4, wherein:

said power feeder means comprises a plurality of horn waveguides disposed within a coplanar array beneath said plurality of rectangular waveguides and parallel to said plurality of rectangular waveguides.

8. An antenna as set forth in claim 7, further comprising:

matching members are disposed within opposite ends of said coplanar rectangular waveguide array; and a terminal resistor is disposed within a central portion of said coplanar rectangular waveguide array.

9. An antenna as set forth in claim 1, wherein:

said power feeder means comprises a horn waveguide.

10. An antenna as set forth in claim 1, wherein:

said means for converting said two independent dominant mode powers into two plane waves comprises a lens antenna.

11. An antenna as set forth in claim 1, further comprising:

a terminal resistor disposed within an end portion of said rectangular waveguide which is disposed opposite said power feed opening.

12. An antenna as set forth in claim 1, wherein:

the depth of said rectangular waveguide is gradually reduced as one proceeds in the longitudinal direction of said waveguide away from said power feed opening.

13. An antenna as set forth in claim 1, wherein:

the width of said rectangular waveguide is gradually reduced as one proceeds in the longitudinal direction of said waveguide away from said power feed opening.

14. An antenna as set forth in claim 1, wherein:

said power feeder means comprises a plurality of horn waveguides connected to said power feed opening of said rectangular waveguide.

15. An antenna as set forth in claim 1, wherein:

said power feeder means comprises an offset reflector.

16. An antenna as set forth in claim 1, wherein:

said power feeder means comprises a Cassegrain reflector.

17. An antenna as set forth in claim 1, wherein:

said power feeder means comprises a Gregorian reflector.

18. An antenna as set forth in claim 1, wherein:

said power feeder means comprises a parabolic reflector.

19. An antenna as set forth in claim 1, wherein:

said power feeder means comprises a waveguide having vertical and horizontal slot openings defined therein.

* * * * *